US006231408B1

(12) United States Patent
Lekhtman

(10) Patent No.: US 6,231,408 B1
(45) Date of Patent: May 15, 2001

(54) DRIVE MECHANISM ASSEMBLY FOR AQUATIC VEHICLE

(75) Inventor: David Lekhtman, Beaconsfield (CA)

(73) Assignee: Future Beach Corporation (CA)

( * ) Notice: Subject to any disclaimer, the term of this patent is extended or adjusted under 35 U.S.C. 154(b) by 0 days.

(21) Appl. No.: 09/671,396

(22) Filed: Sep. 27, 2000

Related U.S. Application Data

(63) Continuation-in-part of application No. 09/375,036, filed on Aug. 16, 1999, now Pat. No. 6,135,835.

(51) Int. Cl.[7] ..... B63H 16/20
(52) U.S. Cl. ..... 440/29; 440/26
(58) Field of Search ..... 440/21–32, 58–60, 440/62

(56) References Cited

U.S. PATENT DOCUMENTS

| | | | | |
|---|---|---|---|---|
| 2,704,990 | * | 3/1955 | Alfaro | 440/22 |
| 4,676,755 | | 6/1987 | Yagan | 440/26 |
| 4,795,381 | | 1/1989 | Willems | 440/26 |
| 4,891,024 | | 1/1990 | Benjamin | 440/28 |
| 4,943,251 | | 7/1990 | Lerach et al. | 440/27 |
| 5,011,441 | * | 4/1991 | Foley et al. | 440/30 |
| 5,217,398 | | 6/1993 | Meron et al. | 440/26 |
| 5,308,268 | | 5/1994 | Schmid | 440/30 |
| 5,362,264 | * | 11/1994 | Parant | 440/29 |
| 5,540,604 | * | 7/1996 | Dayton | 440/27 |
| 5,651,706 | * | 7/1997 | Kasper | 440/29 |

* cited by examiner

*Primary Examiner*—Ed Swinehart
(74) *Attorney, Agent, or Firm*—Mark Kusner

(57) ABSTRACT

A pedal powered drive mechanism and an aquatic vehicle having such a mechanism are constructed primarily of lightweight inexpensive moulded plastic. The vehicle has a buoyant hull with a central longitudinal axis and saddle seat. Handle bar steering is mounted to the hull and a pedal powered drive mechanism drives a stem mounted propeller. The mechanism is constructed of moulded plastic components for simple assembly and results in an inexpensive lightweight drive compared to conventional metal components. The drive has a housing with two axially spaced apart shaft bearing cradles. The crank shaft is disposed in the cradles, with opposing crank arms and pedal mounts extending perpendicular to the crank shaft axis and outward of the cradles. A drive pulley is mounted on the shaft between the cradles by sliding a pulley central opening along the shaft over at least one pedal mount. Collars disposed on the shaft between the pulley and each cradle retain the assembly in a simple manner.

13 Claims, 9 Drawing Sheets

DRIVE MECHANISM ASSEMBLY FOR AQUATIC VEHICLE

This application is a continuation-in-part of application No. 09/375,036 filed on Aug. 16, 1999 now U.S. Pat. No. 6,135,835.

TECHNICAL FIELD

The invention is directed to a molded plastic modular drive mechanism assembly for a peddle powered aquatic vehicle with a propeller driven by pedal cranks, a toothed pulley, and water-cooled belt drive transmission, T-bar steering handles, a saddle seat and lateral outriggers to enable a passenger to ride the vehicle in a manner similar to a bicycle over a water surface.

BACKGROUND OF THE ART

Recreational aquatic vehicles must be extremely low cost in order to enable them to be commercial viable. In addition, recreational aquatic vehicles must be practically maintenance free and very simple to operate since they are used by a wide variety of people of different ages in often remote locations.

Moulded plastic components are well recognized as being low cost and accurate, however for many mechanical components, the strength and reliability of plastic components is insufficient. In the recreational aquatic vehicle market, the use of plastic components has traditionally been limited to boat hulls, canoes and floats. Metal remains the designer's material of choice when motorized components are used, despite the relatively high cost and weight penalty.

The description of the invention uses a pedal powered aquatic vehicle as an example however, the invention is equally applicable to any recreational aquatic vehicle that does not require external power and is powered either by pedaling action of the passengers. The muscles in the legs on a person are the largest muscle group and the human body is naturally inclined to provide maximum power through the action of the legs.

Submerged propellers used almost exclusively in modern motorized nautical transport. To date however propellers have not been used for recreational non-motorized aquatic vehicles mainly since the associated mechanism is considered too complex, heavy and expensive for commercial viability.

It is an object of the present invention to provide a drive mechanism for a propeller driven pedal powered aquatic vehicle that can be produced inexpensively enough to render it practical for recreational use.

It is a further object of the invention to provide pedal powered drive means for an aquatic vehicle which can be produced using conventional plastic moulding techniques.

It is a further object of the invention to provide an easily maintained mechanism for a pedal powered aquatic vehicle which can be ridden in a manner similar to a bicycle wherein the passenger straddles the vehicle.

It is a further object of the invention to provide a propeller driven mechanism that is not subject to accidental damage during normally expected handling by unskilled operators.

Further objects of the invention will be apparent from review of the disclosure and description of the invention below.

DISCLOSURE OF THE INVENTION

The aquatic vehicle has a buoyant hull with a central longitudinal body with the saddle seat allowing a passenger to be supported in a straddling position. To provide lateral stability two elongate outriggers are disposed laterally from the central hull body with outrigger arms connecting the body to the outriggers. A manual steering mechanism is attached to the hull for steering by the passenger; preferably in the form of a T-bar journaled to the hull connected with cords to a rear mounted rudder.

Pedal powered drive means are mounted to the hull for driving a stem mounted propeller. A pair of pedal cranks are journaled for rotation about a transverse axis. A longitudinal drive shaft with a propeller mounted on the rear end is connected to transmission means mounted on the forward end of the shaft for rotating the shaft in response to rotation of the pedal cranks.

Within the hull of the vehicle is a hollow sump chamber within which the drive means are housed. Preferably, the transmission includes a toothed pulley and toothed drive belt providing gear reduction to a final drive sprocket disc mounted to the longitudinal shaft. The drive belt is twisted between the toothed pulley and the final drive disc in order to provide very inexpensive gear reduction and transfer the direction from rotation about transverse axis to rotation about the longitudinal shaft axis.

The sump is partially flooded with water from a water inlet. Water floods into the sump when the craft with passenger float on the water at a level which submerges the inlet. The drive mechanism is water cooled as water from the sump is splashed over moving parts. Water and any sand or foreign particles are discharged from the sump through a sleeve about the propeller shaft through a drain opening adjacent the propeller.

The propeller includes a central hub and pivotally mounted blades which fold rearwardly to avoid damage when encountering obstacles or when the vehicle is dragged on the beach. The folding of the propeller blades also permits gliding of the vehicle on the water surfaces reducing water resistance.

Therefore, the invention provides significant advantages over prior art aquatic vehicles. The simplicity of the drive system enables the vehicle to be manufactured very cheaply of plastic moulded parts and can be maintained by relatively unskilled persons. The simple drive mechanism is not more complicated than a typical bicycle drive system, for example. The toothed pulley however provides the continuity of thrust required for continuously driving a propeller at high rotational speeds. The simple twisting of the drive belt eliminates the need for complex gear reduction mechanisms to increase the rotational speed and transfer the orientation of rotation from transverse to axial which significantly adds to the cost, can be difficult to maintain and results in friction losses. The simple mechanism and housing can be constructed of relatively inexpensive plastic moulded components. Water-cooling is provided in order to maintain the operating temperature of such plastic components below a temperature where heat damage could occur.

The simple hull may be inexpensively made of plastic in a conventional blow moulding process. The steering mechanism and seat may also be formed of hollow blow moulded plastic shapes. The outriggers provide lateral stability required for a safe operation and permit the passenger to bank on curves providing a ride sensation similar to bicycle or motorcycle riding.

The drive mechanism is also constructed of moulded plastic components for simple assembly and results in an inexpensive lightweight drive compared to conventional metal components. The drive has a housing with two axially spaced apart shaft bearing cradles. The crank shaft is disposed in the cradles, with opposing crank arms and pedal mounts extending perpendicular to the crank shaft axis and outward of the cradles. A drive pulley is mounted on the shaft between the cradles by sliding a pulley central opening along the shaft over at least one pedal mount. Collars disposed on the shaft between the pulley and each cradle retain the assembly in a simple manner.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
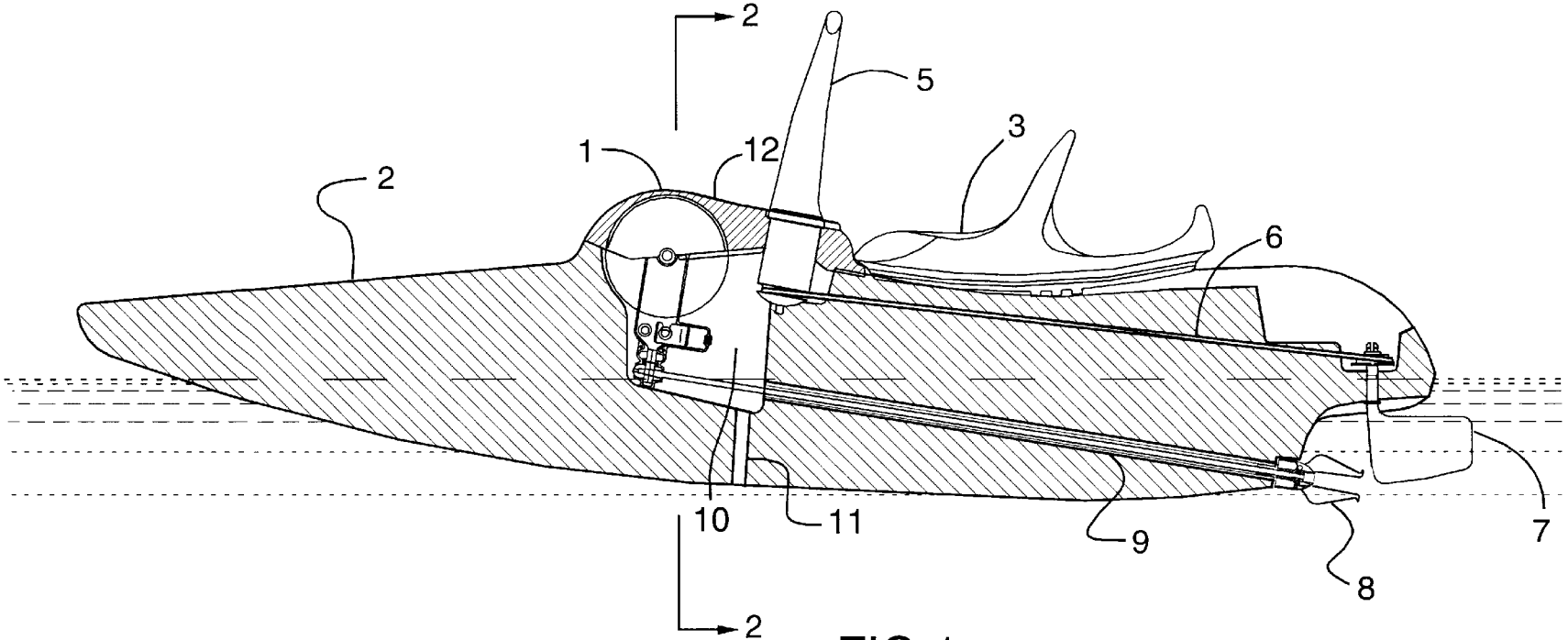
FIG. 1 is a longitudinal cross-sectional view through the aquatic vehicle showing the saddle seat, a T-bar steering column and a forward sump within which is housed with a pedal powered drive mechanism, a longitudinal drive axle and folding propeller.
Figure 2:
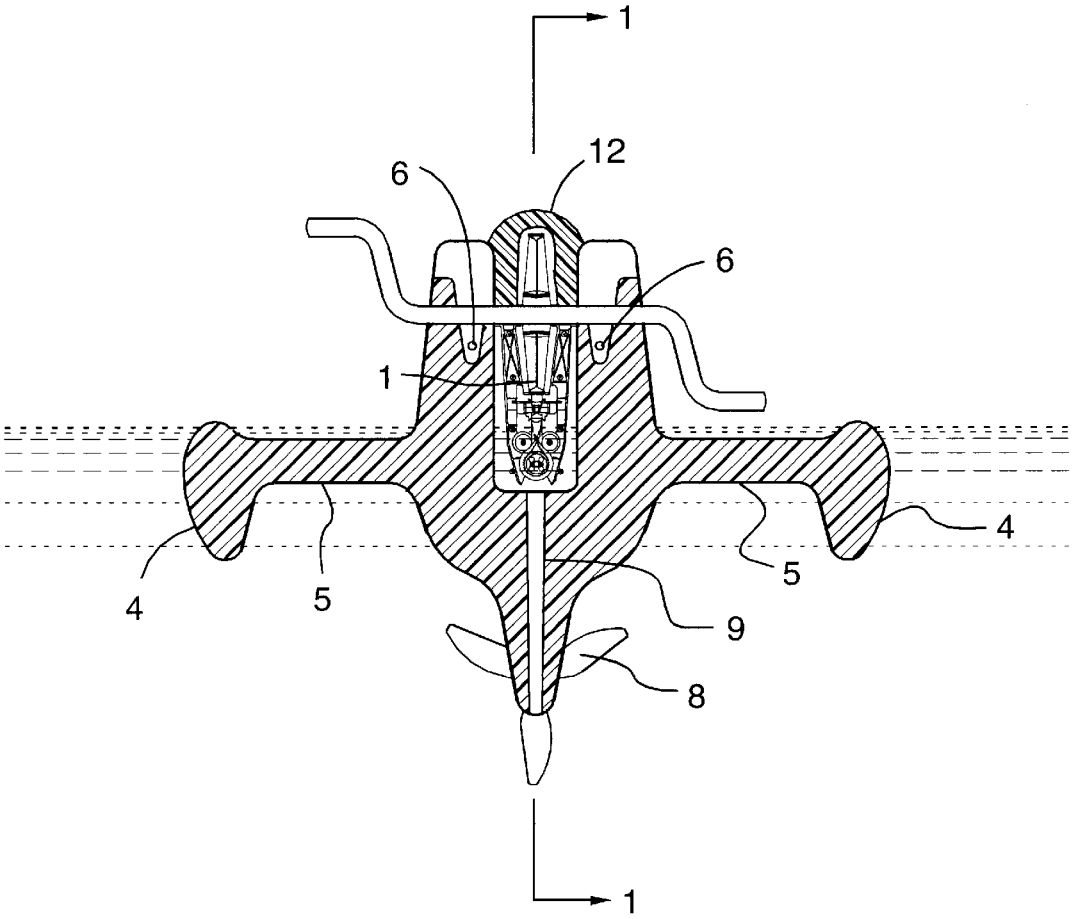
FIG. 2 is transverse cross sectional view along lines 2—2 of FIG. 1 illustrating the cross sectional shape of the hull with lateral outriggers, partially water filled sump and central body with downwardly extended keel.

FIGS. 1 and 2 show a longitudinal sectional view through an aquatic vehicle that includes a drive mechanism 1 according to the invention. The hull 2 includes an elongate central hull body with a saddle seat 3 for straddling the hull body by the passenger. The hull 2 includes two elongate outriggers 4 disposed laterally outwardly from the hull body with outrigger arms connecting the hull body to the outriggers 4. The outriggers 4 provide lateral stability and enable the passenger to bank the vehicle on curves. The outrigger arms also provide a resting position for the feet of the passenger. The entire hull 2 can be formed as a hollow hull by plastic blow moulding processes well known to those skilled in the art.

A blow moulded hollow T-bar steering handle 5 is journaled for rotation in an opening in a plastic housing cap 12. The steering handle 5 is secured to cords 6 disposed in a groove in the body to rotate the rudder 7.

The propeller 8 is rotated by an axle 9 driven by the pedal powered drive mechanism 1 (described below in detail). The propeller 8 has a central hub with three blades that rotate between an open position (shown in FIG. 3) transverse to the hub and a closed position (shown in FIG. 1). When the hub rotates rapidly, the centrifugal force and water pressure exerted on the blades force them to the open position. The advantages of this propeller include the ability to avoid damage when the aquatic vehicle is dragged on shore or encounters underwater obstacles. As well, the folding of the blades permit the passenger to cease pedaling without disengaging their feet from the pedals.

Figure 3:
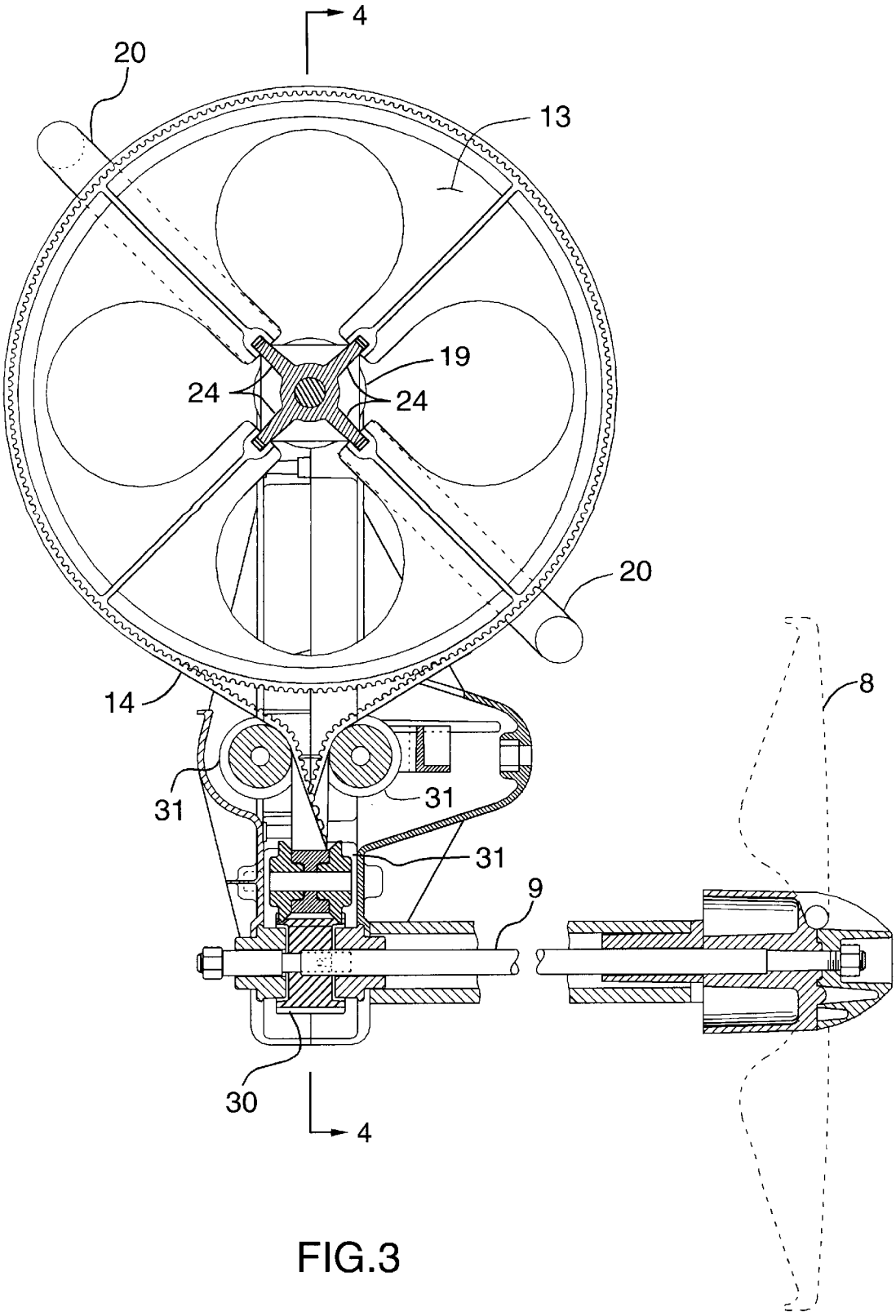
FIG. 3 is a longitudinal cross-sectional view through the pedal powered drive mechanism showing from top to bottom: the pedal cranks, toothed pulley mounted on the crank shaft; drive belt extending past idlers to twist 90° and engage a final disc mounted to the forward end of the drive axle to drive the folding propeller
Figure 4:
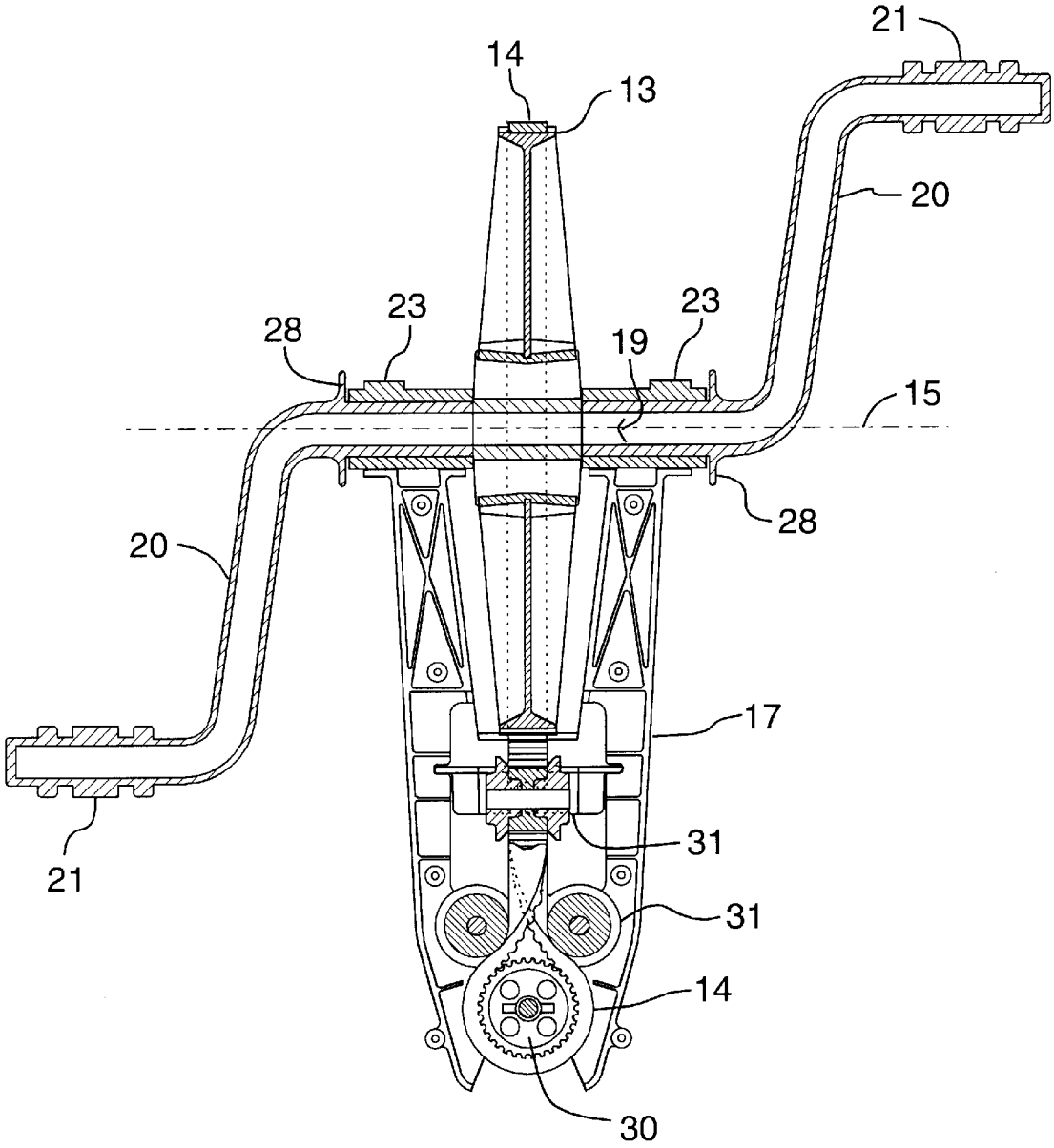
FIG. 4 is a transverse cross-sectional view along line 4—4 of FIG. 3.

Referring to FIGS. 3 and 4, the aquatic vehicle includes novel pedal powered drive 1 which in the embodiment illustrated is housed within a sump 10 covered with a cap 12. The sump 10 is a hollow cavity formed within the hull 2 which includes a water inlet 11, that is disposed to flood a lower portion of the sump 10 with water when the hull 2 is immersed in water. The flooding of the lower portion of the sump 10 provides water for splash cooling of the drive 1 when the belt 14 rotates and draws water into the housing 16, 17.

Figure 5:
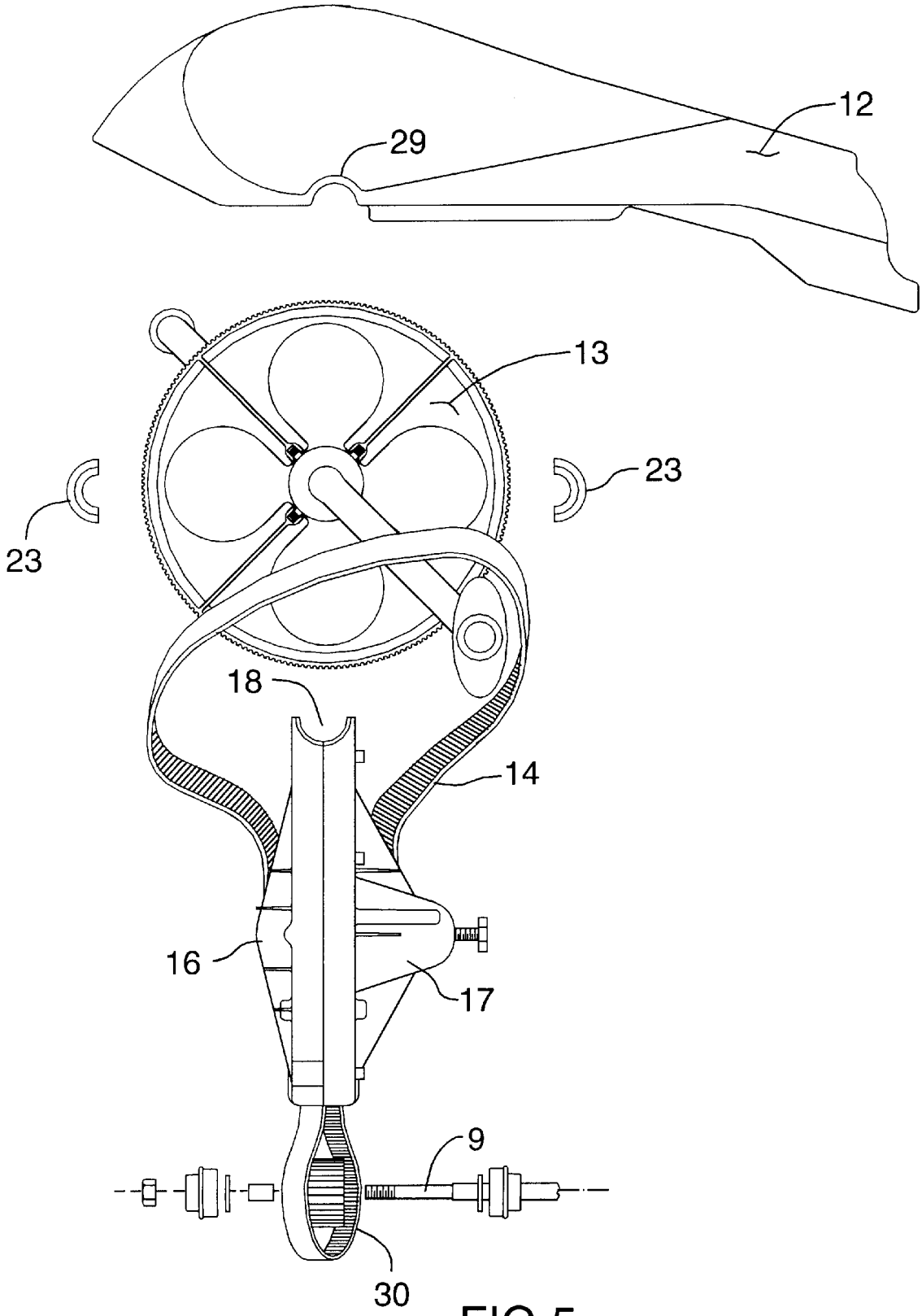
FIG. 5 is a partially exploded side view showing the assembly of the pedal drive mechanism with belt removed.

As shown in FIGS. 4 and 5 the pedal powered drive mechanism includes a crank shaft 19 with a pair of pedal crank arms 20 journaled for rotation about a transverse axis 15. In the embodiment illustrated, the shaft 19 has a toothed pulley 13 that includes teeth on its periphery to engage a toothed drive belt 14. The drive belt 14 runs over idler rollers 31 that serve to twist the drive belt 14 through an angle of 900 to engage a final drive disc 30 mounted on the inward end of the longitudinal axle 9. Support for these components is provided by a split housing 16, 17 preferably formed of moulded plastic.

Preferably, the drive belt 14 is of the type similar of the timing chain of an automobile engine that includes semi cylindrical ridges for accurate power transmission and avoidance of slippage. The use of a flexible drive belt 14 with transversely oriented idlers 31 enables a simple drive mechanism to be provided where the belt 14 is twisted between the toothed pulley 13 and final disc 30. This simple mechanism avoids the complexity of gear reduction and power losses resulting from use of conventional meshed gear transmissions. As well, the entire assembly can be economically constructed of robust plastic components that are accurately and inexpensively moulded.

Water-cooling is provided by immersing the disc 33 and a lower portion of the drive belt 14 in the water which floods into the lower portion of the sump 10. The motion of the belt 14 and disc 30 splashes water for cooling within the interior of the housing 16, 17 and circulates water within the sump 10.

Referring to FIGS. 3 and 4 the idler rollers 31 each include a central roller and two outer-flanged rollers. The central roller and flange rollers are each mounted for independent co-axial rotation on a common idler axle. The primary function of the central roller is to engage the wide outer surface of the belt 14 as the belt 14 engages and disengages the toothed pulley 13 and disc 30. The flanged rollers engage the lateral edges of the belt 14 and maintain alignment especially as required during the twisting of the belt 14. Without the flanged rollers of the idlers 31, the edges of the belt 14 would tend to wander and improper alignment of the ridges in the belt 14 and grooves in the sprockets would result in excessive wear and belt damage.

The assembly of the drive mechanism 1 is uniquely designed to be economically constructed of molded plastic components where possible and to eliminate the need for mechanical fasteners or other means thereby simplifying manufacturing, use and maintenance. As shown in FIGS. 3 and 4, the pedal-powered drive mechanism 1 has a transverse axis 15 about which the crank shaft 19 and pulley 13 rotate. A hollow rotary molded plastic housing (shell components 16 and 17 and housing cap 12) support the crank shaft 19 in two axially spaced apart shaft bearing cradles 18. In the embodiment illustrated, the shaft 19 is entirely enclosed with a removable semi cylindrical bracket 29 forming part of the housing cap 12. Screws or bolts (not shown) connect the plastic housing shells 16 and 17 together as well as secure the cap 12 to the housing components 16 and 17 and hull 2.

The crank shaft 19 is disposed to rotate about the axis 15 and rests in each of the cradles 18. Opposing crank arms 20 and foot pedal mounts 21 extend perpendicular to the crank shaft axis 15 and extend laterally outward of the cradles 18.

Figure 7:
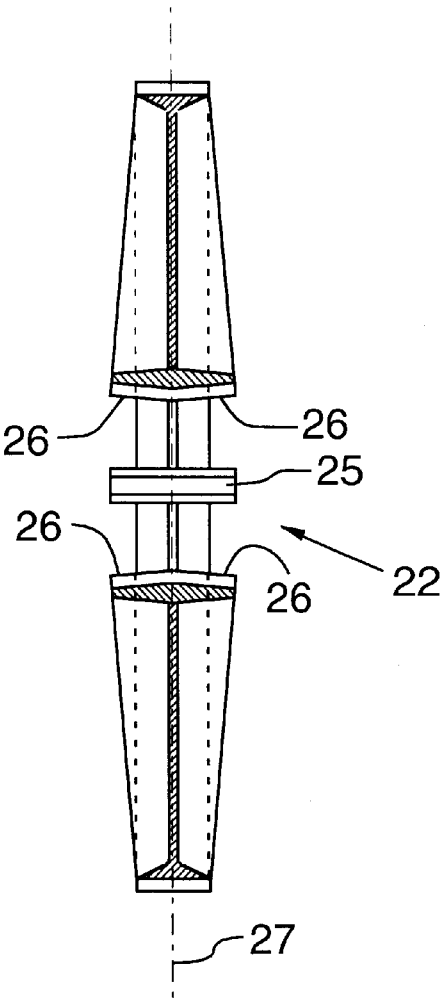
FIG. 7 is a midline sectional view through the pulley.
Figure 6:
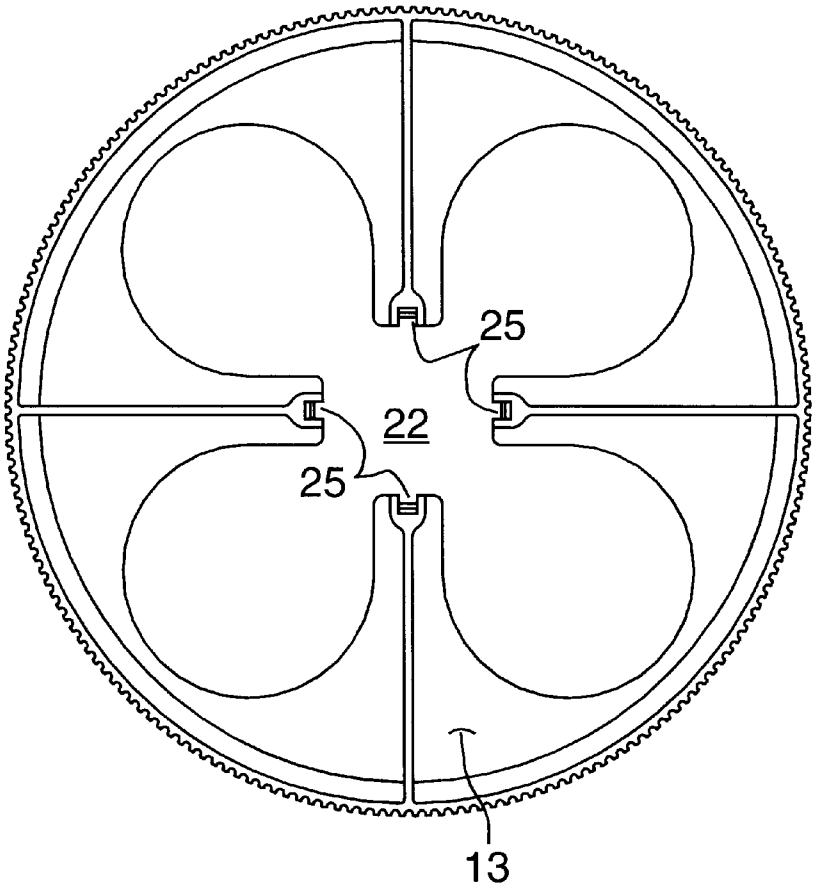
FIG. 6 is a detail side elevation view of the pulley.
Figure 10:
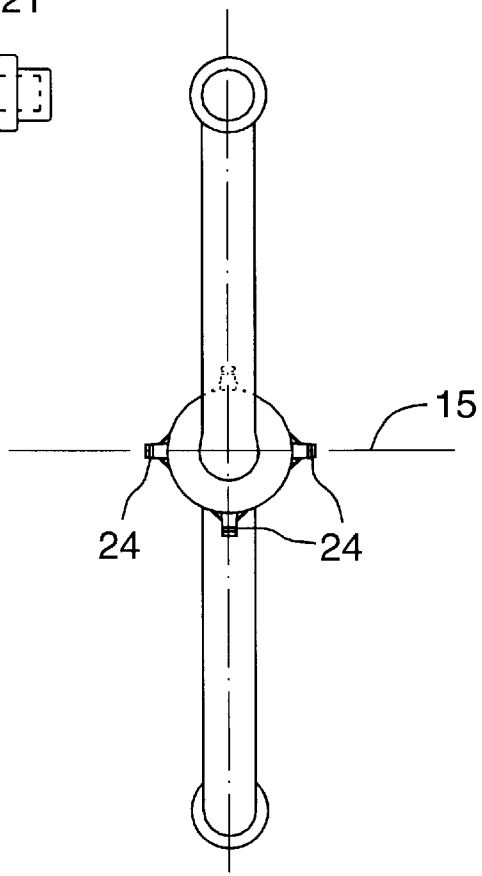
FIG. 10 is a side elevation view of the crank shaft.

As best shown in FIG. 4, the pulley 13 is disposed on the shaft 19 between the cradles 18. Mounting means on the shaft 19 and pulley 13 mount the pulley 13 to be driven together with the shaft 19 by pedaling action of the passenger. As seen in FIGS. 6, 7 and 3, the pulley 13 has a central opening 22 that enables the pulley 13 to slide over the shaft 19 and over at least one of the pedal mounts 21 to assemble the pulley 13 on the shaft 19. Referring to FIGS. 4 and 5, semi cylindrical collars 23 are provided on both sides of the pulley 13, between the pulley 13 and each cradle 18 serving to centre the pulley 13 and also serve as friction bearings or supports.

The detailed assembly of the pulley 13 on the shaft 19 is seen in FIGS. 6 through 10. The shaft 19 includes four elongate axially extending splines 24 which match elongate rectangular grooves 25 about the pulley's central opening 22. Although the splines 24 are illustrated in a cruciform array having four splines with gussets reinforcing between the splines 24, it will be apparent to those skilled in the art that any number of splines 19 and grooves 24 can be provided without departing from the teaching of this invention.

The pulley 13 is resiliently locked to the shaft 19 with mating tapered surfaces 26 that are symmetric about the transverse central plane 27 of the pulley 13. When the pulley 13 is manufactured of plastic, there is a certain amount of flexibility or resilience when the tapered surfaces 26 engage. Forcing the pulley 13 onto the shaft 19 engages the tapered surfaces 26 and serves to snap lock or resiliently lock the grooves 25 on the mating splines 24.

Figure 9:
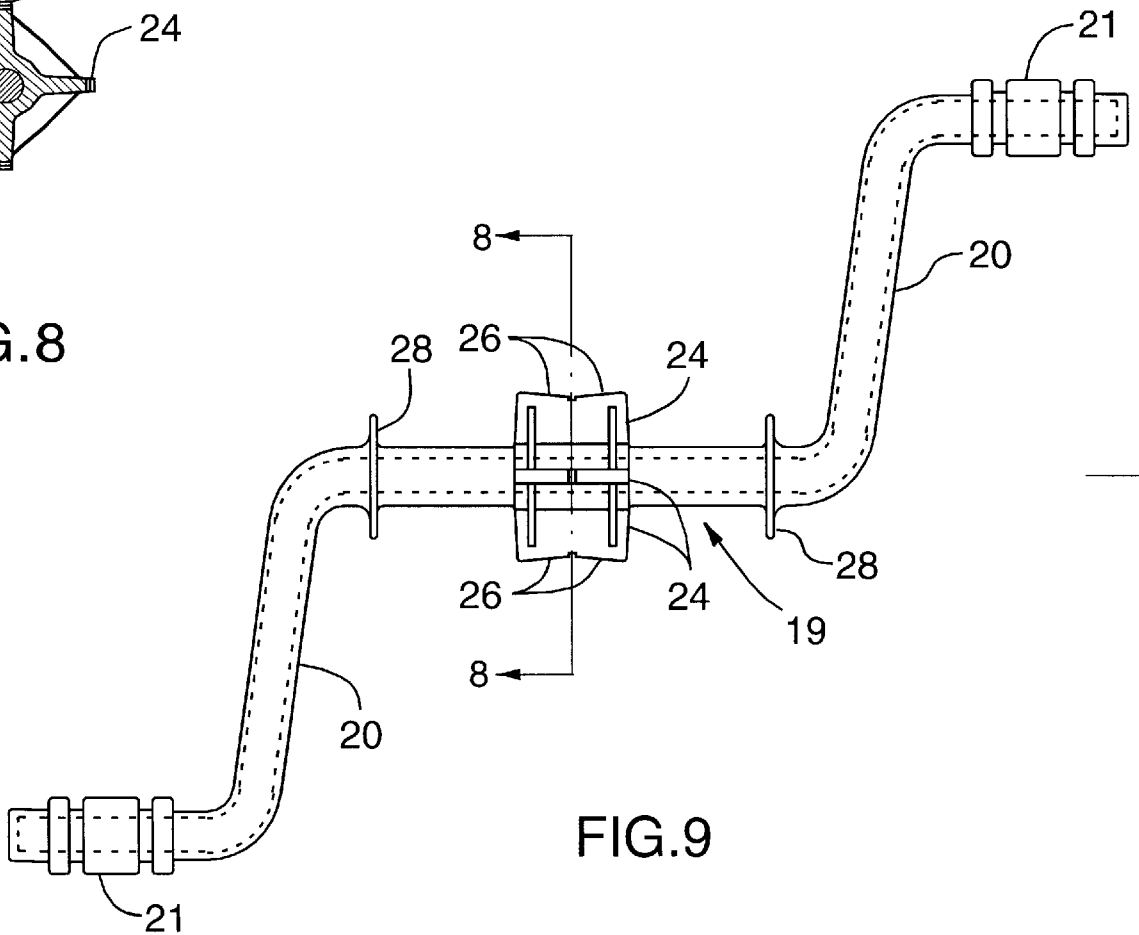
FIG. 9 is a detail front elevation view of the crank shaft.
Figure 8:
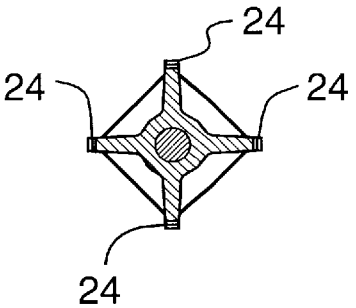
FIG. 8 is a detail sectional view along line 8—8 of FIG. 9.
Figure 11:
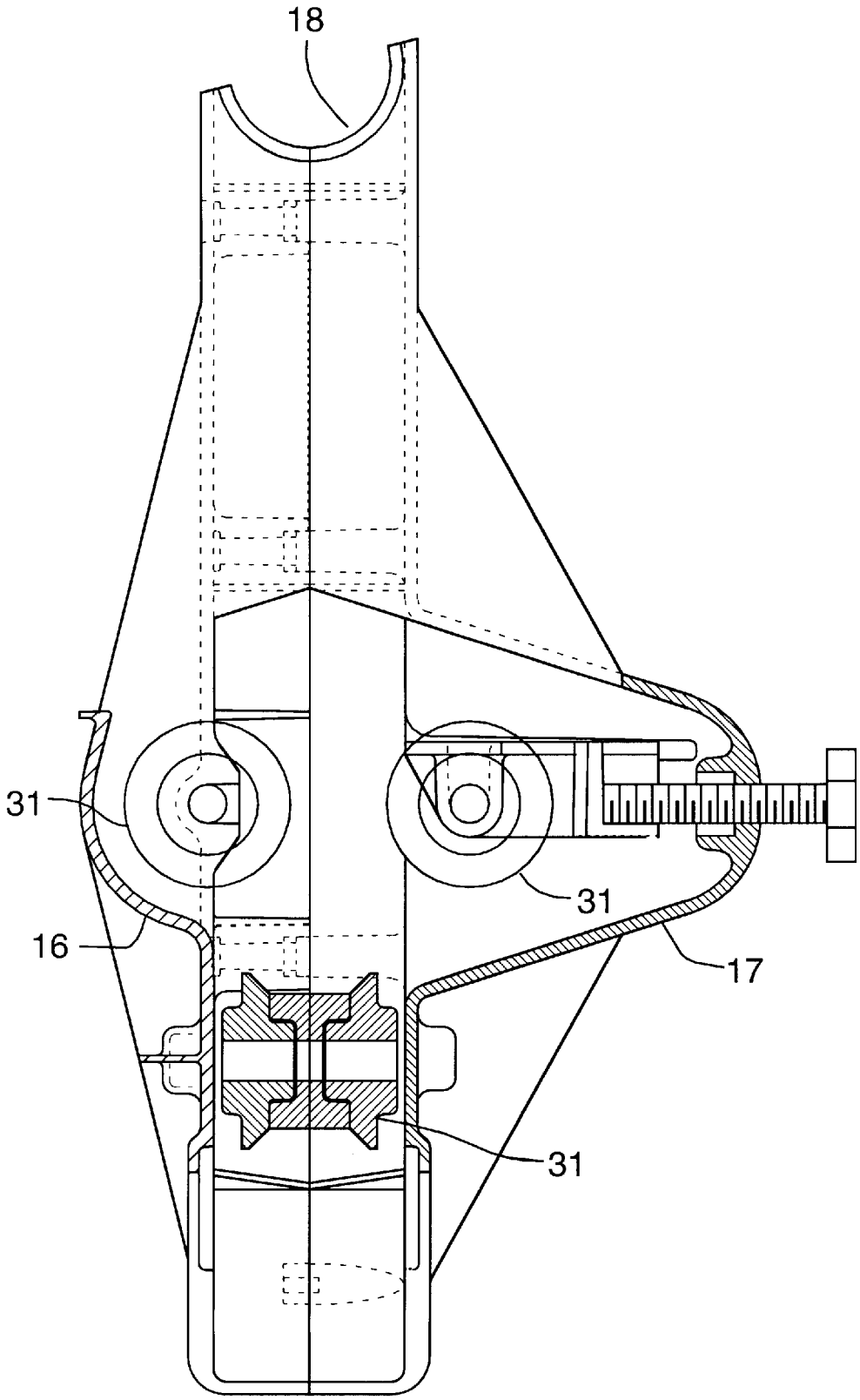
FIG. 11 is a detail side sectional view through the housing showing the assembly of idler rollers in the housing with screw belt tensioning adjustment.
Figure 12:
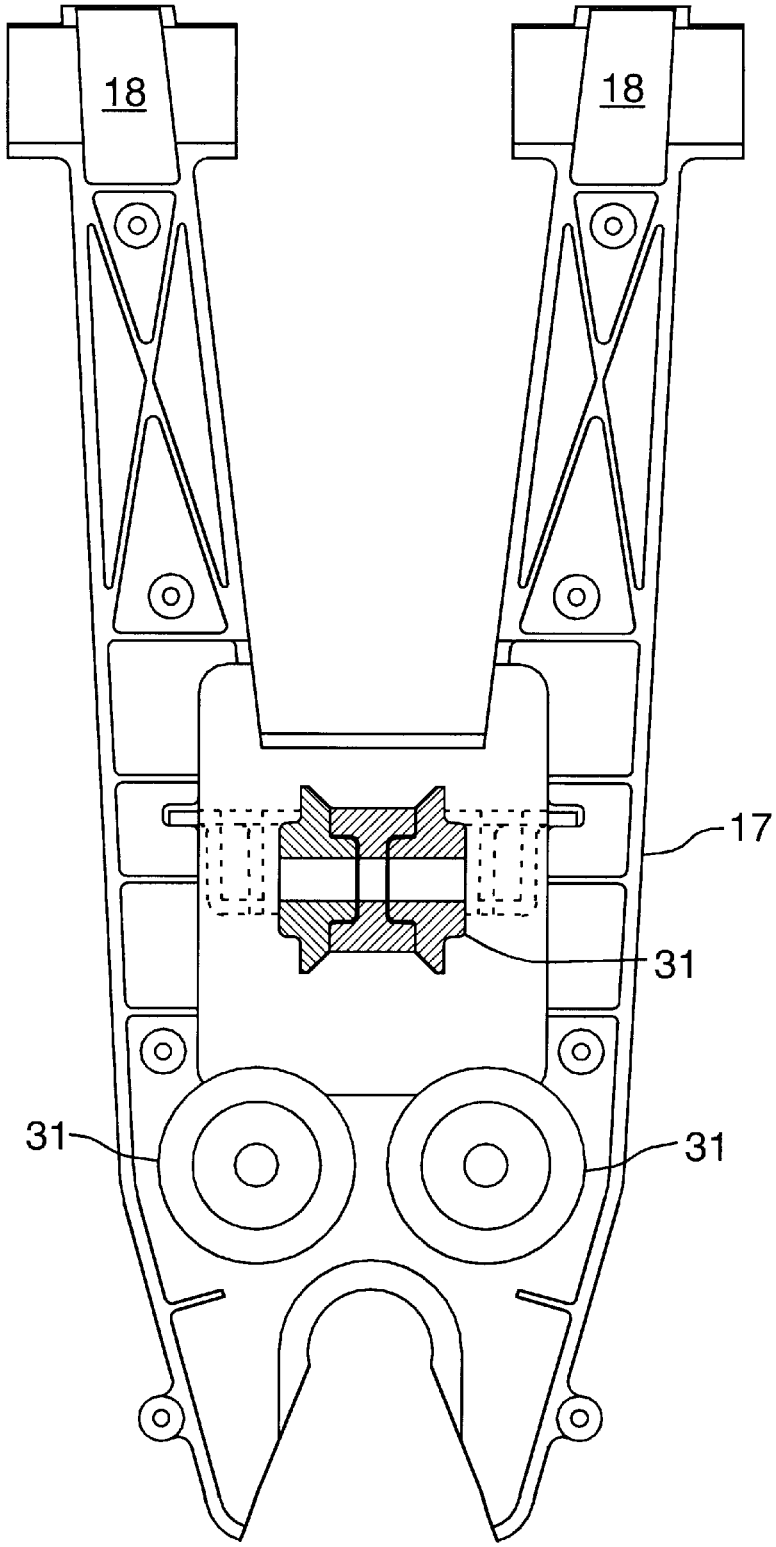
FIG. 12 is a detail front sectional view through the housing of FIG. 1.

Also as shown in FIGS. 4 and 9, the shaft 19 preferably includes transverse shoulders 28 outward of the cradles 18 that serve to physically seal the mechanism 1 from external environment, align the shaft 19 in the cradles 18 and aid in holding the brackets 29 of the cap 12 in place.

As described above therefore, the water-cooled drive mechanism 1 can be simply constructed of moulded plastic components in an economical manner. The drive mechanism 1 is extremely simple to manufacture and maintained thereby overcoming the major impediment to providing an practical pedal-powered propeller-driven aquatic vehicle.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A pedal powered drive mechanism having an axis, the mechanism comprising:

a housing having a shaft bearing support comprising two axially spaced apart shaft bearing cradles;

a crank shaft, disposed on the axis and in the cradles, with opposing crank arms and pedal mounts extending perpendicular to the crank shaft axis and outward of the cradles;

a pulley disposed on the shaft between the cradles;

mounting means on the shaft and pulley for mounting the pulley to be driven by the shaft, the mounting means including central opening means on the pulley for sliding a pulley central opening along the shaft over at least one said pedal mount; and collar means disposed on the shaft between the pulley and each cradle.

2. A drive mechanism according to claim 1 wherein the mounting means comprise:

a plurality of elongate axially extending splines along the shaft; and matching elongate grooves about the pulley central opening.

3. A drive mechanism according to claim 2 having splines and grooves of substantially rectangular cross-section.

4. A drive mechanism according to claim 2 wherein the shaft includes four splines in a cruciform array.

5. A drive mechanism according to claim 2 wherein the splines and grooves have resilient locking means for locating and securing the shaft and pulley in axial relation.

6. A drive mechanism according to claim 5 wherein the resilient locking means comprise tapered mating surfaces symmetric about a transverse central plane of the pulley.

7. A drive mechanism according to claim 1 wherein the shaft includes transverse shoulders axially outward of the cradles.

8. A drive mechanism according to claim 1 wherein each cradle encircles the shaft and includes a removable semi-cylindrical bracket.

9. A drive mechanism according to claim 1 wherein the pulley is a toothed pulley and the mechanism includes a drive belt engaging a periphery of the toothed pulley and the periphery of a final drive disc mounted co-axially on a longitudinal propeller axle.

10. A drive mechanism according to claim 9, the toothed pulley journaled for rotation about said transverse axis and wherein the drive belt is twisted by a 90° angle between the toothed pulley and final drive disc.

11. A drive mechanism according to claim 9 including idler rollers engaging the drive belt between the toothed pulley and disc.

12. A drive mechanism according to claim 11 wherein the housing comprises two mating shells about the idler rollers, final drive disc and a portion of the belt.

13. An aquatic vehicle comprising:

a buoyant hull with a central longitudinal axis and saddle seat;

steering means mounted to the hull for manual steering by the passenger; and pedal powered drive means having an axis mounted to the hull for driving a stem mounted propeller wherein the mechanism comprises:

a housing having a shaft bearing support comprising two axially spaced apart shaft bearing cradles;

a crank shaft, disposed on the axis and in the cradles, with opposing crank arms and pedal mounts extending perpendicular to the crank shaft axis and outward of the cradles;

a pulley disposed on the shaft between the cradles;

mounting means on the shaft and pulley for mounting the pulley to be driven by the shaft, the mounting means including central opening means on the pulley for sliding a pulley central opening along the shaft over at least one said pedal mount; and collar means disposed on the shaft between the pulley and each cradle.

* * * * *